US005118247A

United States Patent [19]

Royden

[11] Patent Number: 5,118,247

[45] Date of Patent: Jun. 2, 1992

[54] WIDE LOAD RACK FOR FORKLIFT

[76] Inventor: Mathew N. Royden, 14576 High Valley Rd., Poway, Calif. 92064

[21] Appl. No.: 586,146

[22] Filed: Sep. 21, 1990

[51] Int. Cl.[5] ..... B66F 9/16

[52] U.S. Cl. ..... 414/607; 414/10; 414/667; 414/672

[58] Field of Search ..... 414/607, 608, 785, 664, 414/667, 668, 671, 672, 10, 666, 670

[56] References Cited

U.S. PATENT DOCUMENTS

| | | | |
|---|---|---|---|
| 3,416,686 | 12/1968 | Penrod | 414/785 X |
| 3,567,054 | 3/1971 | Emke | 414/785 X |
| 3,881,535 | 1/1975 | Huxley, III et al. | 414/785 X |
| 4,159,059 | 6/1979 | Christenson et al. | 414/607 X |
| 4,306,825 | 12/1981 | Yilit | 414/785 X |
| 4,708,576 | 11/1987 | Conley | 414/607 |
| 4,787,810 | 11/1988 | Cawley et al. | 414/672 X |
| 4,838,753 | 6/1989 | Gehman et al. | 414/667 X |
| 4,948,326 | 8/1990 | Bedard | 414/785 X |
| 4,951,990 | 8/1990 | Hollan et al. | 414/785 X |

FOREIGN PATENT DOCUMENTS

| | | | |
|---|---|---|---|
| 640439 | 5/1962 | Canada | 414/667 |
| 2240633 | 2/1974 | Fed. Rep. of Germany | 414/607 |

*Primary Examiner*—David A. Bucci

[57] ABSTRACT

A rack for attachment to the backboard of a forklift has a very long laterally extended beam with forwardly extended, adjustable tangs, the rack being designed primarily for use in engaging wide sections of roof ordinarily having a truss along one long ede with the purpose being to safely and conveniently lift each roof section into place adjacent the previous roof section which was similarly put in place, and so forth, during the construction phase of a building such as a warehouse.

1 Claim, 2 Drawing Sheets

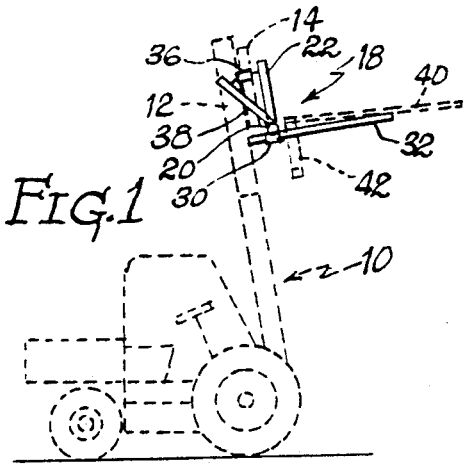
FIG. 1
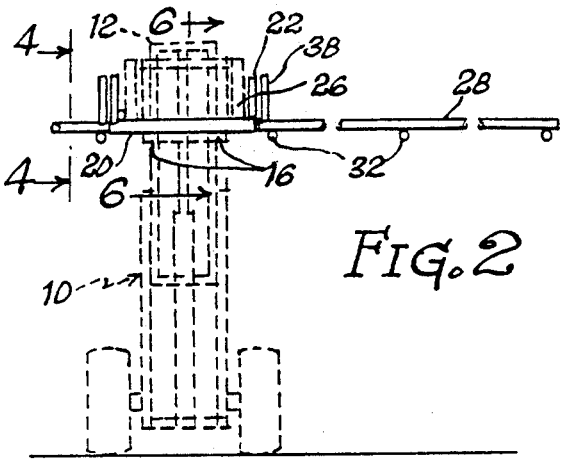
FIG. 2
FIG. 3
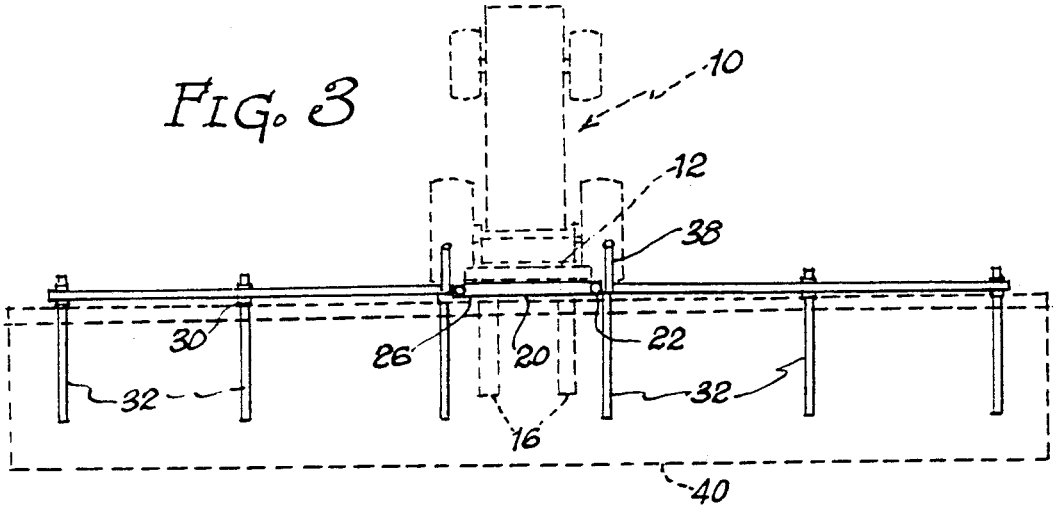
FIG. 4
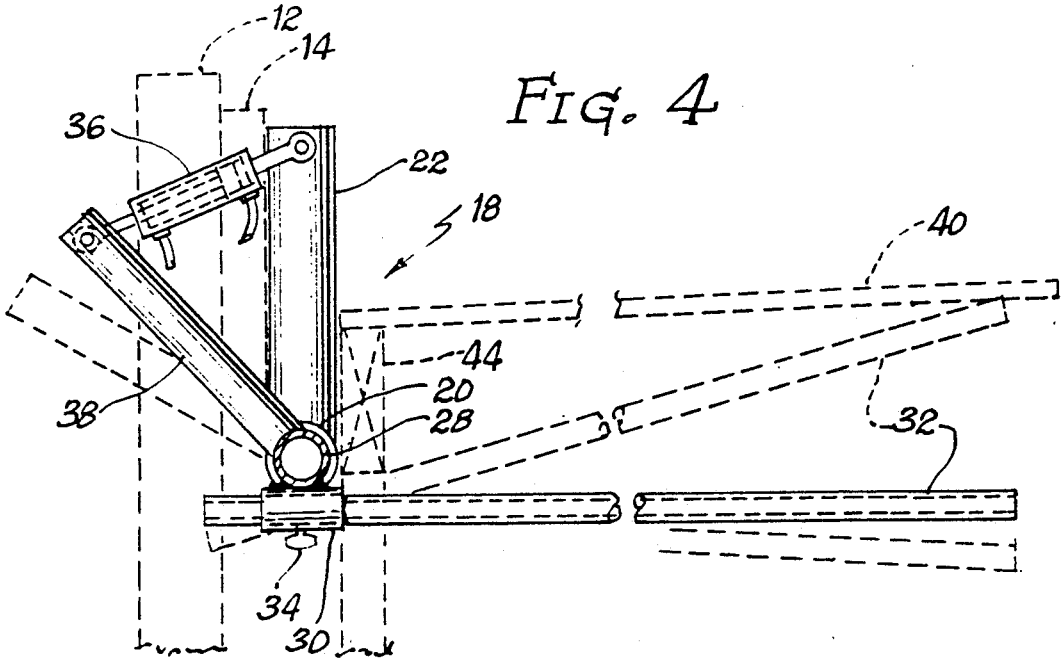

WIDE LOAD RACK FOR FORKLIFT

BACKGROUND OF THE INVENTION

The instant invention relates to the building construction industry and particularly to the construction of building roofs using a technique in which wide, relatively narrow consecutive sections of the roof, having a support truss along one edge, are consecutively raised and placed in position against the last section that was put in place, so that each section has a truss along one edge, with the other edge being supported by the truss of the previous section of the roof which was installed. Roof sections are in this fashion laid consecutively, each one being attached to the previously installed section until the entire roof, or at least a very wide swath of the roof, has been completed.

When roofs are constructed in this way, each roof section is very wide laterally, relatively narrow, and is quite unwieldy. The wide section is engaged by a forklift which passes its forks beneath the truss, which is on the side of the section toward the forklift, with the ends of the forks having some type of spacer to reach up to the level of the roof section, with a wide spanner bar passing across the spacers to stabilize the section. Because the section of the roof is so wide, and the forks engage beneath the truss which is several feet below the level of the main roof section, the operation is very unstable and somewhat dangerous. The laterally extended length of the roof section has a large moment arm around the forklift, and the instability is aggravated by the fact that main portion of the roof, that is the horizontal roof section, is spaced several feet above the forklift forks because of the need to engage the forks beneath the truss.

Additionally, there is only minimal control of the remote edge of the roof section by the front ends of the forks, which support the spacers, which in turn support a relatively short spanner beam that supports the far edge of the roof section.

There is a need for a rack which mounts on a forklift that would pass through the upper portion of the truss, with tangs supporting the roof section at multiple points along its length, with the tangs being rotatably adjustable about a transverse axis to accurately, horizontally orient the roof section, and create the ability to more positively engage it as it is being positioned.

SUMMARY OF THE INVENTION

The instant invention fulfills the above stated need by providing a specialized rack which is created specifically to elevate and position wide roof sections in a stable and safe manner.

The rack comprises a frame, which in turn comprises a lateral, horizontal tube mounted to the backboard of the forklift. A long beam passes through the tube, extending a considerable distance to each side, and is rotatable within the tube. The beam mounts forwardly extended tangs, which are adjustable in how far forwardly they extend, and the beam itself can be rotated about its axis by means of hydraulic cylinders mounted between radial arms rigidly fixed to the beam and structure on the frame to rotate the tangs.

BRIEF DESCRIPTION OF THE DRAWINGS

FIG. 1 is a side elevation view of a forklift, shown in phantom, with the rack in place;

FIG. 2 is a front elevation view of the configuration of FIG. 1;

FIG. 3 is a top plan view of the configuration of FIGS. 1 and 2, illustrating the forklift diagrammatically in phantom;

FIG. 4 is a section taken along lines 4—4 of FIG. 2 illustrating the details of operation of the hydraulic cylinder beam rotating mechanism;

DETAILED DESCRIPTION OF THE PREFERRED EMBODIMENT

Figure 5:
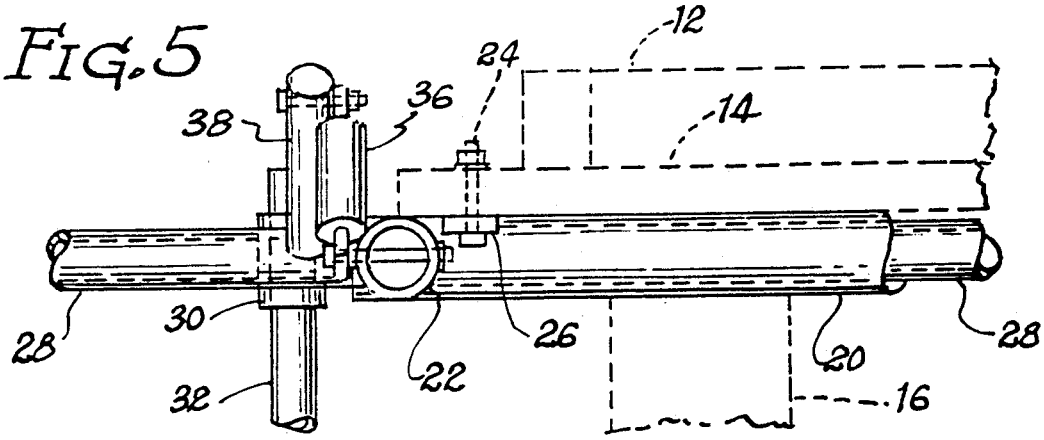
FIG. 5 is a top plan view of a portion of the rack illustrating the rotating mechanism.

The forklift to which the invention is attached is illustrated in phantom in FIGS. 1–3 at 10. As shown in FIG. 5, a forklift has a lifter frame 12 and typically a backboard 14 mounted to the lifter frame. At the bottom of the backboard there are generally a pair of forks 16 although in many applications the forks are omitted.

Figure 6:
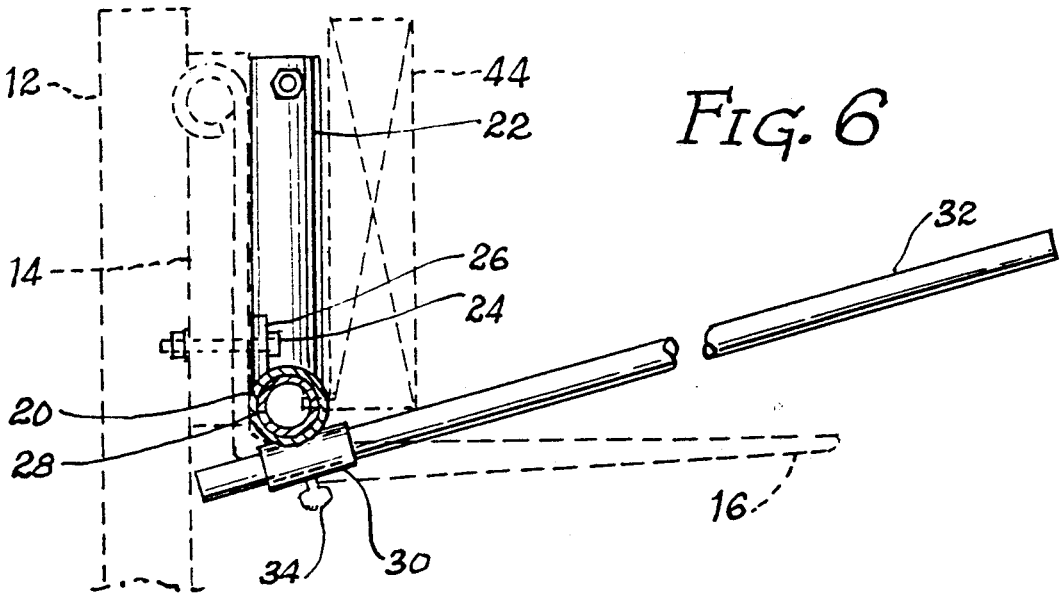
FIG. 6 is a section taken along line 6—6 of FIG. 2 and illustrates how up-rotated tangs stabilize a single beam.

The instant invention comprises a rack, generally indicted at 18, which is mounted to the backboard 14. Although there are a number of variations of the way in which the rack can be constructed, in the illustrated embodiment it comprises a main heavy-duty laterally extended horizontal tube 20, with a pair of heavy posts 22 welded to the ends of the tube and projecting upwardly as seen from the top in FIG. 5 and from the side in FIG. 6. The main tube 20 is mounted to the backboard by bolts 24 which pass through the backboard and engage heavy brackets 26 which are welded to the tube. Although two bolts and brackets are shown, obviously more could be used if needed to support the load.

The interior of the tube 20 is maintained clear because a transverse cylindrical beam 28 passes through the tube and extends a considerable distance to each side as shown in FIG. 3. Although it is not shown in the drawings, the beam is long enough that in some applications it might be required, or at least be beneficial, to provide stays and guy wires as a superstructure to the beam to support it at its outer ends.

Spaced along the beam in both direction are sockets 30 which are welded to the beam and define cylindrical bores which are longitudinally extended relative to the direction of the forklift. In each of these bores is a forwardly extended tang 32, which is free to slide within the bore, and is locked in place by a set screw 34. Although it may seem tedious to adjust 6 tangs (the number shown in FIG. 3) by manipulating the set screws, ordinarily this would be done only once for a large job, inasmuch as the roof panels that would be installed in a particular job would generally be uniform.

In addition to the tangs being adjustable in their forward extent, they are rotatably adjustable by virtue of the fact that the beam 28 is rotatable about its axis in the tube 20. Rotation is forced by means of hydraulic cylinders 36 which are mounted between the tops of the posts 22 and the ends of radial arms 38 which are welded to the beam 28 on opposite sides of the main tube 20. As is easy to visualize from FIG. 4, operation of the hydraulic cylinders will rotate the tangs concomitantly up or down as shown in phantom.

The rack of the invention is intended to be used for roof panels, one of which is indicated in phantom at 40 in FIG. 3. The roof panel would typically have a truss 42 shown in FIG. 1 which extends across its entire width. The truss is open, and the tangs of the rack would extend beneath the uppermost beam 44 of the truss as shown in FIG. 4. From an inspection of FIG. 4, it can be seen why it is necessary to rotate the tangs upwardly to support the far edge of the roof panel 40 horizontally, because of the inboard beam 44. Of course, the beam may be of different dimensions with different roof panels, and the angle of the lifter frame 12, as shown in FIG. 1, may vary and must be compensated for by rotating the tangs up or down to establish the roof panel horizontally. Upwardly rotated tangs would also be effective in stabilizing a single, thick laminated beam, or a single truss unattached to a roof panel, as the cant of the tangs would tend to throw the member being carried back against the backboard as is well illustrated in FIG. 6.

In practice, very wide prefabricated roof panels such as that shown in FIG. 3 will be consecutively placed between long parallel roof joists which support the outer ends of the roof panels. The roof panels are consecutively put in place, one after the other so that the edge of the roof panel that has no truss is mounted to the edge of the previously installed roof panel, which is the edge having the truss beneath it. It is a very efficient way of making a roof for a large building, and especially a large open building, such as a warehouse or a factory.

Figure 7:
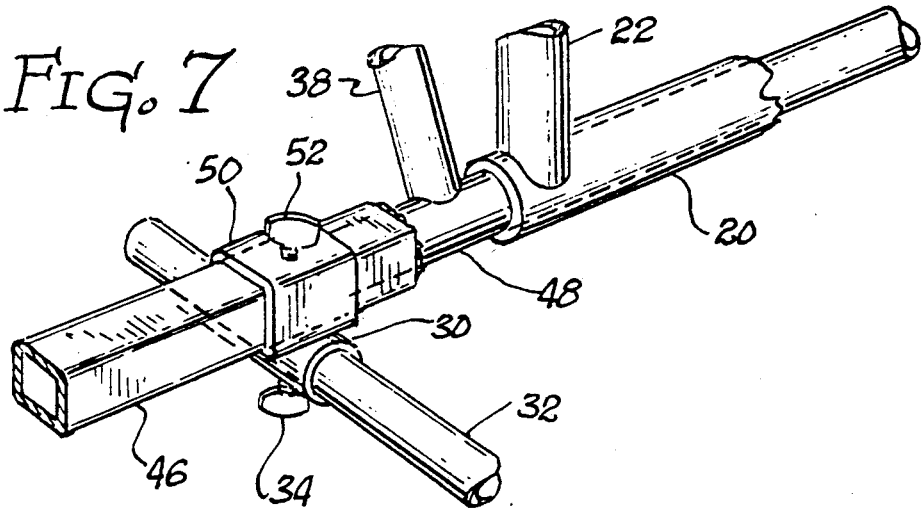
FIG. 7 is a perspective view of a detail of a slightly modified version of the invention in which the beam is acircular.

It can be easily understood that in some instances it would be desirable or even necessary to vary the spacing between the tangs to accommodate different roof panels and their accompanying trusses. In order to do this, the sockets 30 can be made slidable along the beam 22, where they remain in place under the action of friction, or with the assistance of a set screw or the like. Of course, in order for the sockets to slide along the beam rather that being welded to it, the beam must be acircular, such as the rectangular beam shown in FIG. 7. In FIG. 7, the rectangular beam 46 fairs into a cylindrical portion 48 which rotates freely within the tube 20 to achieve the rotational adjustability of the tangs. In this embodiment, the sockets 50 are themselves rectangular, sliding along the rectangular beam 46. The remaining portion of the socket can be the same. A set screw 52 or an equivalent locking mechanism can be used to secure the socket at any desired spacing along the beam.

Thus, for any particular job, and for any particular type of roof panel, the rack can quickly be adjusted, both in the spacing of the tangs and the extent to which the tangs project forwardly to achieve a safe and secure engagement of the roof panel, holding it just underneath the horizontal portion rather than beneath the truss, providing a safer, stabler, and easier-to-use manner of effecting prefabricated panel roof construction than that provided by previously used techniques and equipment.

It is hereby claimed:

1. A rack for attachment to a backboard of a forklift having a backboard, said rack comprising:

(a) a rigid frame;

(b) a beam bilaterally extending from said frame, said beam having a central portion;

(c) a plurality of tangs forwardly extending from said beam to support a wide roof truss while same is being positioned;

(d) said frame comprising a laterally substantially horizontal tube rotatably receiving the central portion of said beam therethrough; and, (e) said frame including a pair of substantially radial posts rigidly mounted to said tube, said beam mounting a pair of rigid substantially radial arms, and including hydraulic cylinders mounted between said respective posts and said arms to permit said beam to be hydraulically rotated into a multiplicity of rotatably adjusted positions.

* * * * *